US009902537B2

(12) United States Patent
Abou-Odah et al.

(10) Patent No.: US 9,902,537 B2
(45) Date of Patent: Feb. 27, 2018

(54) MULTIPURPOSE BOTTLE CAP AND METHODS OF MAKING AND USING SAME

(71) Applicants: Camellia Abou-Odah, San Pedro, CA (US); Basimah Khulusi, San Pedro, CA (US)

(72) Inventors: Camellia Abou-Odah, San Pedro, CA (US); Basimah Khulusi, San Pedro, CA (US)

( * ) Notice: Subject to any disclaimer, the term of this patent is extended or adjusted under 35 U.S.C. 154(b) by 0 days.

(21) Appl. No.: 15/344,924

(22) Filed: Nov. 7, 2016

(65) Prior Publication Data

US 2017/0073132 A1 Mar. 16, 2017

Related U.S. Application Data

(63) Continuation of application No. 14/516,210, filed on Oct. 16, 2014, now Pat. No. 9,517,181.

(Continued)

(51) Int. Cl.
*A61J 11/04* (2006.01)
*B65D 51/28* (2006.01)

(Continued)

(52) U.S. Cl.
CPC ..... *B65D 51/2821* (2013.01); *A61J 9/008* (2013.01); *A61J 9/085* (2013.01); *A61J 11/008* (2013.01);

(Continued)

(58) Field of Classification Search
CPC ..... B65D 41/20; B65D 51/2821; A61J 9/008; A61J 9/085; A61J 11/04

(Continued)

(56) References Cited

U.S. PATENT DOCUMENTS 2,787,268 A 4/1957 Greenspan
2,793,776 A * 5/1957 Lipari ..... A61J 1/2093 206/221

(Continued)

FOREIGN PATENT DOCUMENTS

KR 1019990049136 A 7/1999
KR 1020010090202 A 10/2001

OTHER PUBLICATIONS

PCT Patent Application PCT/US2015/024069 International Search Report and Written Opinion dated Jun. 29, 2015, 11 pages.

(Continued)

*Primary Examiner* — Sue A Weaver
(74) *Attorney, Agent, or Firm* — Lathrop Gage L.L.P.

(57) ABSTRACT

A dual chambered receptacle configured to retain a first ingredient and a second ingredient comprises a first portion having a cover and a rupturing member. The receptacle includes a second portion having a cup and a perimeter portion. The second portion is configured to be removably secured to the first portion. The cup is configured to retain the first ingredient. A seal is coupled to first portion and the second portion when the first portion is removably secured to the second portion. The receptacle includes a vessel having a mouth. The vessel is configured to retain the second ingredient. The seal is configured to detach from the second portion to allow the first ingredient to fall into the vessel to mix with the second ingredient when the first portion is moved relative to the second portion.

18 Claims, 5 Drawing Sheets

Related U.S. Application Data

(60) Provisional application No. 61/973,853, filed on Apr. 2, 2014.

(51) Int. Cl.

| | |
|---|---|
| ***A61J 9/00*** | (2006.01) |
| ***A61J 9/08*** | (2006.01) |
| ***A61J 11/00*** | (2006.01) |
| ***B65D 41/04*** | (2006.01) |

(52) U.S. Cl.
CPC ..... *A61J 11/0075* (2013.01); *A61J 11/045* (2013.01); *B65D 41/04* (2013.01)

(58) Field of Classification Search
USPC ..... 206/222, 219; 215/DIG. 8
See application file for complete search history.

(56) References Cited

U.S. PATENT DOCUMENTS

| | | | | |
|---|---|---|---|---|
| 4,024,952 | A * | 5/1977 | Leitz | B65D 81/3222 206/221 |
| 5,419,445 | A * | 5/1995 | Kaesemeyer | A61J 1/2093 206/220 |
| 5,772,017 | A * | 6/1998 | Kang | B65D 51/2842 206/222 |
| 5,794,802 | A | 8/1998 | Caola | |
| 5,863,126 | A | 1/1999 | Guild | |
| 6,003,728 | A | 12/1999 | Elliott | |
| 6,257,428 | B1 | 7/2001 | Caola | |
| 7,017,735 | B2 | 3/2006 | Carlson | |
| 7,854,104 | B2 | 12/2010 | Cronin et al. | |
| 8,408,389 | B1 | 4/2013 | Anderson | |
| 8,443,970 | B2 | 5/2013 | Coon | |
| 9,517,181 | B2 * | 12/2016 | Abou-Odah | A61J 9/008 |
| 2003/0072850 | A1 | 4/2003 | Burniski | |
| 2008/0314775 | A1 * | 12/2008 | Owoc | B65D 25/08 206/222 |
| 2012/0199503 | A1 * | 8/2012 | Dyrbye | B65D 47/243 206/222 |

OTHER PUBLICATIONS

Karmacap Bottle Cap at Website at http://karmacapco.com/index.html, 2014.

* cited by examiner

MULTIPURPOSE BOTTLE CAP AND METHODS OF MAKING AND USING SAME

CROSS-REFERENCE TO RELATED APPLICATIONS

This application is a continuation of U.S. Nonprovisional patent application Ser. No. 14/516,210, titled "Multipurpose Bottle Cap and Methods of Making and Using Same", filed Oct. 16, 2014, which claims priority to U.S. Provisional Patent Application No. 61/973,853 filed Apr. 2, 2014. The disclosure of each is incorporated herein by reference in its entirety.

FIELD OF THE INVENTION

The invention relates generally to the field of multipurpose bottle caps. More specifically, the invention relates to bottle caps configured to retain solids and liquids, and which allow these solids and liquids to be conveniently dispensed into the bottle.

SUMMARY

According to an embodiment, a dual chambered receptacle configured to retain a first ingredient and a second ingredient comprises a first portion and a second portion. The first portion has a cover and a rupturing member. The cover includes a top portion and a side portion having threading. The rupturing member extends from the top portion and has an elongated member and a rupturing portion. The second portion has a cup and a perimeter portion. The cup is configured to retain the first ingredient, and comprises an upper side having an upper edge and a lower side having a lower edge. The upper side comprises threading. The perimeter portion surrounds the cup, is spaced apart from the cup, and has a top edge and a bottom edge. In a use configuration, the top edge is below the upper edge and the bottom edge is above the lower edge. A seal is coupled to the rupturing portion and the lower edge when the cover is threadingly secured to the upper side. The receptacle includes a vessel having a mouth. The vessel is configured to retain the second ingredient, and the mouth is configured to be plugged by the lower side. The seal is configured to detach from the lower edge to allow the first ingredient to fall into the vessel to mix with the second ingredient when the first portion is moved relative to the second portion.

According to another embodiment, a method of mixing a first ingredient with a second ingredient comprises the step of providing a dual chambered receptacle. The dual chambered receptacle comprises: a first portion having a cover and a rupturing member extending from the cover; a second portion having a cup and a perimeter member at least partially surrounding the cup; and, a vessel having a mouth. The method includes the step of removably securing the first portion to the second portion, and the step of situating the first ingredient in the cup and the second ingredient in the vessel. A seal is coupled to the rupturing member and the cup to temporarily seal the cup. The mouth is plugged with the cup. When the first portion is moved relative to the second portion, the seal ruptures, thereby causing the first ingredient to fall into the vessel.

According to another embodiment, a dual chambered receptacle configured to retain a first ingredient and a second ingredient comprises a first portion having a cover and a rupturing member. The receptacle includes a second portion having a cup and a perimeter portion. The second portion is configured to be removably secured to the first portion. The cup is configured to retain the first ingredient. A seal is coupled to first portion and the second portion when the first portion is removably secured to the second portion. The receptacle includes a vessel having a mouth. The vessel is configured to retain the second ingredient. The seal is configured to detach from the second portion to allow the first ingredient to fall into the vessel to mix with the second ingredient when the first portion is moved relative to the second portion.

According to yet another embodiment, a cap for a vessel configured to retain a first ingredient comprises a first portion having a cover and a rupturing member that extends from the cover. A second portion of the cap has a cup and a perimeter portion. The second portion is configured to be removably secured to the first portion. The cup is configured to retain a second ingredient. A seal is coupled to first portion and the second portion when the first portion is removably secured to the second portion. The seal is configured to rupture upon movement of the first portion relative to the second portion.

BRIEF DESCRIPTION OF THE SEVERAL VIEWS OF THE DRAWINGS

Illustrative embodiments of the present invention are described in detail below with reference to the attached drawing figures and wherein.

DETAILED DESCRIPTION

It is often desirable to mix or otherwise combine one consumer product (e.g., a food, drink, drug, dye, et cetera) with another prior to use. For example, cocoa powder and other powdered drink mixes (e.g., protein powder drink mixes) may be mixed with water or milk prior to consumption. Similarly, for example, alcohol (e.g., Vodka) may be combined with a flavored beverage (e.g., a fruit drink such as orange juice) prior to being drunk. In some instances, the two (or more) companion consumer products may be combined at any time (e.g., days, months, or even years) prior to use. In other instances, however, it may be preferable to combine the two (or more) companion products shortly (e.g., hours, minutes, or even seconds) before use. For example, it may be undesirable to pre-mix cocoa powder and milk long before consumption, as the thermal processing of the pre-mixed cocoa powder drink may cause the cocoa powder to lose many of its valuable nutrients. Similarly, it may be disadvantageous to mix alcohol with a flavored beverage long before consumption, as the flavored beverage may drastically reduce the shelf life of the alcohol. This need for combining the two or more companion products shortly before use is not limited to the food and drinks industry. Many pharmaceutical drugs, for example, sold in powdered form and intended to be consumed as a solution or suspension after the powder is mixed with a liquid (e.g., water, milk, et cetera), lose their effectiveness over time after the ingredients have been mixed. In such cases, it may be preferable to sell the two or more companion products in a solitary package having separate compartments for the storage of the two ingredients, so that the user may mix the ingredients together shortly before use. For the convenience of the user, it may further be beneficial to configure the packaging so as to reduce the effort that the user may otherwise have to expend to mix together the ingredients. The present invention is directed generally to such systems and methods.

Figure 2:
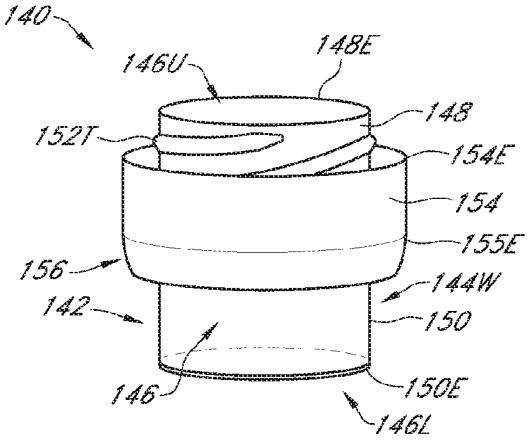
FIG. 2 is a perspective view of a second portion of the first cap.
Figure 3:
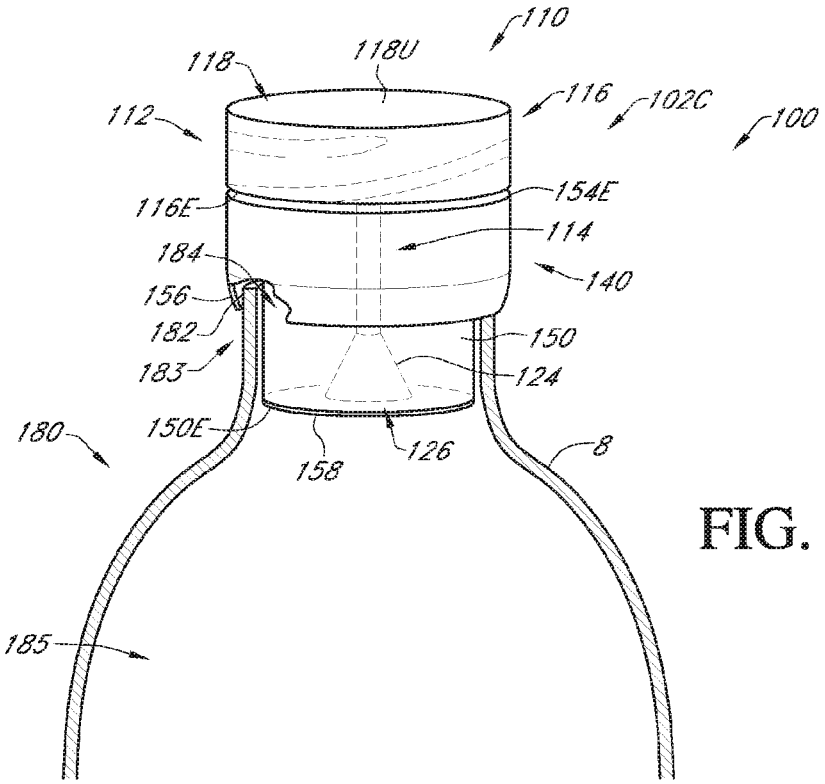
FIG. 3 is a perspective view of a receptacle with the first cap secured thereon.

Attention is directed now to FIG. 3, which shows an embodiment 100 of a dual-chambered receptacle in line with the teachings of the present invention. The receptacle 100 includes a first portion (or "lid") 110 (see FIGS. 1, 3), a second portion (or "secondary container" or "plug") 140 (see FIGS. 2, 3), and a third portion (or "primary container" or "vessel") 180 (see FIG. 3). The lid 110 and the secondary container 140 may also collectively be referred to herein as a cap 102C.

Figure 1:
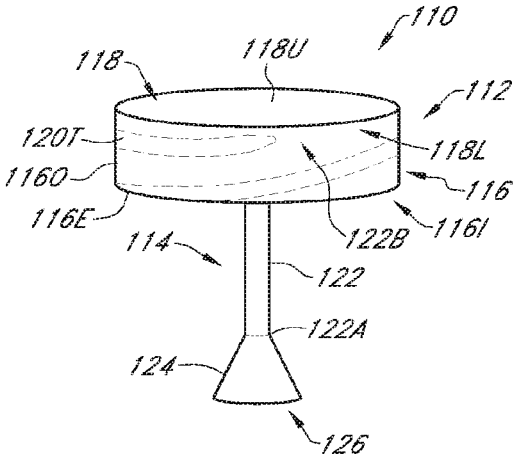
FIG. 1 is a perspective view of a first portion of a first cap, according to an embodiment.

The first portion 110, as best shown in FIG. 1, may include a cover 112 and a rupturing member (or "lever") 114. The cover 112 may have a side portion 116 and a top portion 118. In some embodiments, the side portion 116 may be generally cylindrical and the top portion 118 may be generally circular, as shown in FIG. 1. It will be understood, however, that the side portion 116 and the top portion 118 of the cover 112 may take on other suitable regular or irregular shapes in different embodiments, as desired. In some embodiments, the side portion 116 and the top portion 118 of the cover 112 may be of a unitary construction.

The side portion 116 of the cover 112 may have an outer surface 1160, an inner surface 1161 that opposes the outer surface 1160, and a lower edge 116E. The inner surface 1161 of the side portion 116 may include threading 120T, which is represented in FIG. 1 with dotted lines. The threading 120T may in some embodiments extend for the entire height of the side portion 116, whereas in other embodiments, only a part of the inner surface 1161 (e.g., the part of the inner surface 1161 proximate the rupturing member 114) may include the threading 120T. In other embodiments still, the threading 120T may be omitted entirely, as discussed in more detail below.

The top portion 118 of the cover 112 may have an upper surface 118U and a lower surface 118L (not clearly visible) that opposes the upper surface 118U. The rupturing member 114 may be affixed to the lower surface 118L of the top portion 118. More specifically, the rupturing member 114 may have a generally cylindrical elongated portion 122 having opposing ends 122A, 122B (not clearly visible), and the end 122B of the elongated portion 122 may be secured to the lower surface 118L of the top portion 118. In some embodiments, the lower surface 118L of the top portion 118 may include a threaded receiving portion (not shown) configured to allow the elongated portion 122 to be threaded onto the lower surface 118L of the top portion 118. In other embodiments, the elongated portion 122 may be molded together with the top portion 118, or secured to the lower surface 118L via adhesive or other desirable means.

The rupturing member 114 may comprise a rupturing portion 124, which may extend from the end 122A of the elongated portion 122. The rupturing portion 124 may be generally conical as shown, or may take on other shapes; for example, in some embodiments, the rupturing portion 124 may be cylindrical, or have fan like projections. In other embodiments still, the rupturing portion 124 may be threaded. The rupturing portion 124 may have a smooth bottom surface 126 that may extend generally parallel to the top portion 118.

In some embodiments, the rupturing portion 124 and the elongated portion 122 of the rupturing member 114 may be of unitary construction; in other embodiments, however, the rupturing portion 124 may be a separate component that is secured to the end 122A of the elongated portion 122. For example, in some embodiments, the rupturing portion 124 and the end 122A of the elongated portion 122 may be configured so as to allow the rupturing portion 124 to be threaded onto the elongated portion 122. In other embodiments, the rupturing portion 124 may be secured to the end 122A of the elongated portion 122 using adhesive or other suitable means. It will be understood that the rupturing member 114 shown in the figures is exemplary and that it may configured in other ways. For example, in some embodiments, the elongated portion 122 and the rupturing portion 124 constituting the rupturing member 114 may be of a unitary construction and may, for example, be generally cylindrical (and have the same or different diameters). In other embodiments, the rupturing member 114 may have fan like projections, or take on other suitable shapes.

Focus is directed now to FIG. 2, which shows the second portion or plug 140. The second portion 140 may have a cup 142 having a wall 144W. The wall 144W may be generally cylindrical as shown, and form a generally continuous hollow chamber or cavity 146 having an upper opening 146U and a lower opening 146L. The chamber 146 may be configured to retain an ingredient, as discussed in more detail below.

The wall 144W of the cup 142 may have an upper side 148 having an edge 148E forming the upper opening 146U, and a lower side 150 having an edge 150E forming the lower opening 146L. The edges 148E, 150E, at least in some embodiments, may be generally circular. The outer surface of the lower side 150 of the wall 144W may be generally smooth, whereas the outer surface of the upper side 148 of the wall 144W may include threading 152T. The threading 152T may be configured to correspond to the threading 120T of the first portion 110 (see FIG. 1).

The second portion 140 may further have a perimeter member 154 outwardly adjacent the cup 142. The perimeter member 154 may in some embodiments be generally cylindrical as shown, and may surround at least part of the wall 144W. While not clearly visible in FIG. 2, the inner surface of the perimeter member 154 may be secured to the outer surface of the wall 144W (e.g., via a generally horizontal wall that extends from the outer surface of the wall 144W to the inner surface of perimeter member 154). The perimeter member 154 may have an upper edge 154E that is downwardly adjacent the edge 148E of the cup 142, and a lower edge 155E that is upwardly adjacent the edge 150E of the cup 142. The upper edge 154E of the perimeter member 154 may generally correspond to the lower edge 116E of the first portion 110, as discussed in more detail below.

In some embodiments, the perimeter member 154 may optionally include a slanting portion 156. The slanting portion 156 may extend from the lower edge 155E of the perimeter member 154, slant towards the wall 144W of the cup 142, and terminate prior to reaching the wall 144W. The slanting portion 156 may be configured to mate with a ridge 182 (see FIG. 3) of the third portion or vessel 180.

The vessel 180 may be a bottle as shown in FIG. 3, or another container configured to retain liquids and/or solids, such as a drinking glass, a mug, a bowl, et cetera. The vessel 180 may have a mouth 183 with an opening 184, and a chamber 185 configured to receive an ingredient(s) via the opening 184 as is known in the art. The dimensions of the opening 184 may be configured such that the plug 140, and more specifically the lower side 150 of the cup 142, can be fitted snugly therein to plug the vessel 180. In some embodiments, a diameter of the lower side 150 of the cup 142 may be greater adjacent the perimeter member 154 than at the edge 150E, which may further facilitate the plugging of the vessel 180 by the plug 140.

In some embodiments, the slanting portion 156 of the perimeter member 154 may be slid across the ridge 182 of the vessel 180 such that the slanting portion 156 grips the mouth 183 of the vessel 180. Such an arrangement may help ensure that the cap 102C remains firmly secured to the vessel 180 and prevents its contents from escaping, such as when the vessel 180 is turned upside down or otherwise agitated. It will be appreciated however that in some embodiments the ridge 182 of the vessel 180 may be omitted along with the slanting portion 156 of the perimeter member 154 so long as the lower side 150 of the cup 142 mates with and securely plugs the vessel 180.

Figure 3A:
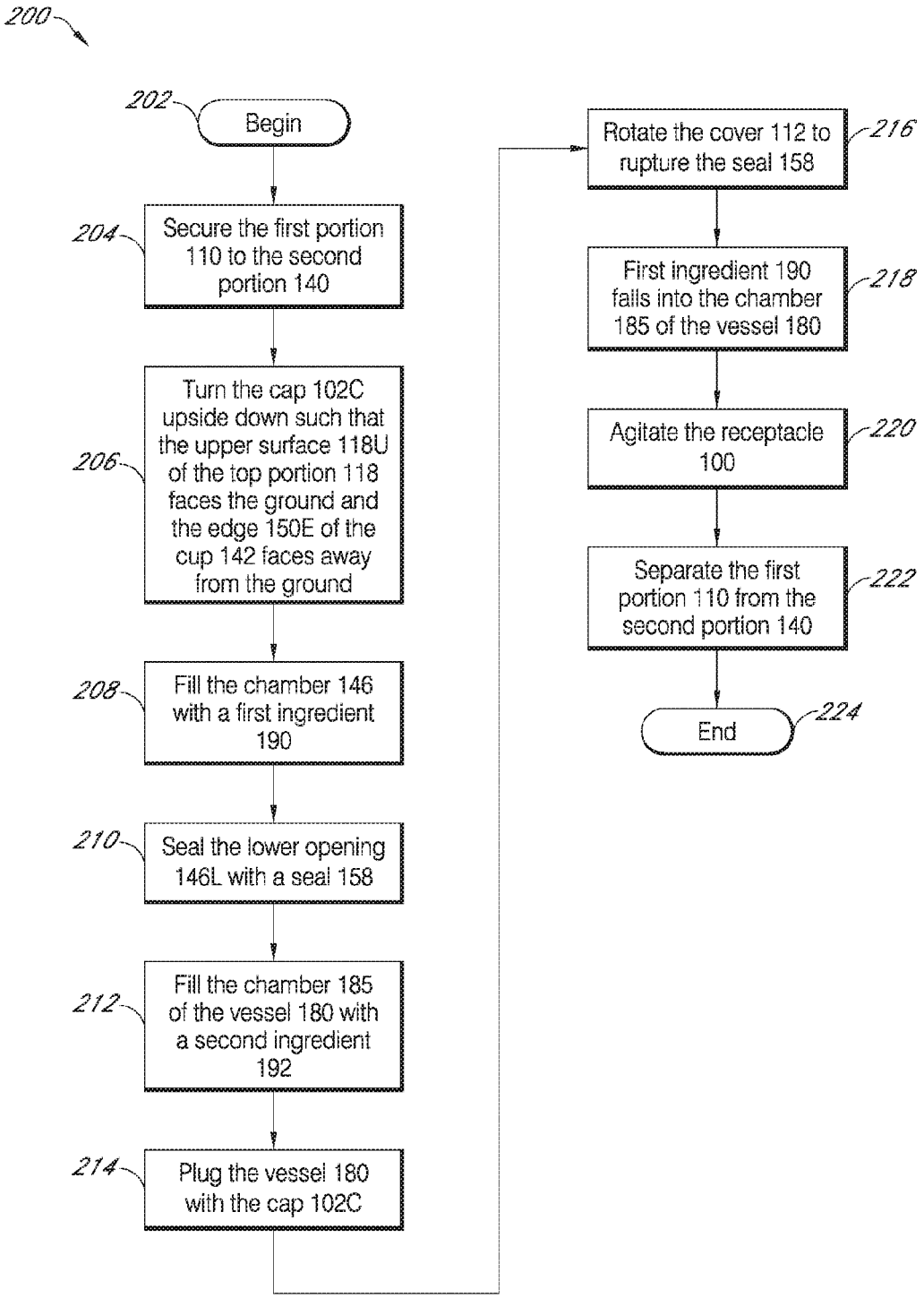
FIG. 3A is a flowchart illustrating a method of using the first cap.

Attention is directed now to FIG. 3A, which shows a method 200 of using the dual chambered receptacle 100. The method 200 may begin at step 202, and at step 204, the lid (i.e., the first portion) 110 may be secured to the secondary container (i.e., the second portion) 140. Specifically, in the embodiment shown in the figures, the rupturing member 114 of the first portion 110 may be passed through the upper opening 146U of the chamber 146 of the second portion 140, and side portion 116 of the cover 112 of the first portion 110 may be secured to the cup 142 (and more specifically, the upper side 148 of the wall 144W of the cup 142) of the second portion 140 using the threading 120T of the cover 112 and the corresponding threading 152T of the cup 142. When so secured: (1) the upper opening 146U (see FIG. 2) may be closed by the lower surface 118L (see FIG. 1) of the top portion 118 of the cover 112; (2) the lower edge 116E (see FIG. 1) of the side portion 116 of the cover 112 may correspond to and be adjacent the upper edge 154E (see FIGS. 2, 3) of the perimeter member 154; and (3) the lower surface 126 (see FIG. 1) of the rupturing portion 124 of the rupturing member 114 may be adjacent and coplanar with the edge 150E (see FIGS. 2, 3) of the lower side 150 of the cup 142. In embodiments where the threading 120T, 152T is absent, the cover 112 may be configured to sealingly mate with the upper side 148 of the cup 112 such that the lower edge 116E of the cover 112 is adjacent and in contact with the upper edge 154E of the perimeter member 154.

At step 206, the cap 102C (i.e., the first portion 110 as secured onto the second portion 140) may be turned upside down such that the upper surface 118U of the top portion 118 faces the ground (or another surface, such as a table for example) and the edge 150E of the cup 142 faces away from the ground. It will be appreciated that this step 206 may be omitted where the first portion 110 is turned upside down (i.e., the upper surface 118U faces the ground) before the first portion 110 is secured to the second portion 140 at step 204.

Next, at step 208, the chamber 146 may be filled (or partially filled) with a first ingredient 190. Specifically, the first ingredient 190 may be filled into the chamber 146 via the lower opening 146L.

At step 210, the chamber 146 of the cup 142 may be hermetically sealed using a seal 158 (see FIG. 3). More particularly, the seal 158 may be configured such that it: (1) bonds to the edge 150E of the cup 142 and fully seals the lower opening 146L of the chamber 146; and (2) bonds to the bottom surface 126 of the rupturing portion 124. Care may be taken to ensure that the bond between the rupturing portion bottom surface 126 and the seal 158 is stronger than the bond between the edge 150E and the seal 158. The seal 158 may be so secured in any suitable fashion, such as by heat induction.

Once the lower opening 146L is sealed at step 210, the first ingredient 190 may be unable to escape from the chamber 146 (without user action, as discussed below). That is, the first ingredient 190 may be unable to escape via the lower opening 146L because of the seal 158, and may be unable to escape via the upper opening 146U because of the first portion 110. At step 212, as is known in the art, the vessel 180 (and specifically the chamber 185 thereof) may be filled (or partially filled) with a second ingredient 192 via the opening 184 in the mouth 183. This step 212 may also be performed before the chamber 146 is filled with the first ingredient 190.

The cap 102C may now be used to plug the third portion (i.e., the vessel) 180. Specifically, at step 214, the cap 102C may be inserted into the opening 184 of the mouth 183 of the vessel 180 such that the lower side 150 of the cup 142 plugs the opening 184. The slanting portion 156 of the perimeter member 154 may also be slid over the ridge 182 as shown in FIG. 3, and further ensure that the contents of the vessel 180 do not inadvertently escape. In some embodiments, the outer surface of the mouth 183 may include threading that correspond to threading (not shown) on the inner surface of the perimeter member 154; in these embodiments, the cap 102C may be threaded onto the mouth 183 of the vessel 180 to close off the chamber 185 of the vessel 180.

The receptacle 100 may now be ready for use. At step 216, a user may rotate the first portion 110, and specifically the cover 112, so as to partially unthread and distance the first portion 110 from the second portion 140. Such rotation of the cover 112 may cause the rupturing member 114 to rotate therewith, which rotation may consequently cause the seal 158 to rupture. More specifically, as the cover 112 is rotated, it may cause the elongated portion 122 of the rupturing member 114 secured thereto to also rotate, which may in turn cause the rupturing portion 124 of the rupturing member 114 (and the lower surface 126 of the rupturing portion 124 to which the seal 158 is bonded) to rotate and rupture the bond between the seal 158 and the edge 150E of the cup 142 of the second portion 140. The seal 158 may resultantly detach from the edge 150E of the cup 142 but remain secured to the lower surface 126 of the rupturing portion 124. Rupturing of the seal at step 216 may cause the first ingredient 190 to fall into the chamber 185 of the vessel 180 and mix with the second ingredient 192 at step 218.

At step 220, if desired, the user may agitate the receptacle 100 so as to allow the first ingredient 190 to better mix with second ingredient 192. At step 222, the user may fully separate the first portion 110 from the second portion 140 (i.e., unthread the first portion 110 from the second portion 140). The seal 158, which may still be secured to the lower surface 126 of the rupturing portion 124, may be detached therefrom and disposed. The user may now enjoy (or otherwise utilize) the second ingredient 192 along with the first ingredient 190, and if desired, secure the first portion 110 back to the second portion 140 (using corresponding threading 120T, 152T) to prevent the remaining contents of the vessel 100 from escaping. The method 200 may end at step 224.

Thus, as has been described, the receptacle 100 may provide a user with an easy and convenient way to combine the second ingredient 192 with the first ingredient 190 shortly prior to use. In some embodiments, the steps 202-214 may be effectuated by a manufacturer or retailer, whereas the remaining steps may be effectuated by an end user.

It will be appreciated that the first ingredient 190 and the second ingredient 192 need not each be a solitary substance, but may instead each be a combination of more than one ingredient. For example, the first ingredient 190 may be a powder mix comprising ground coffee and sugar, and the second ingredient 192 may be a mixture of water and milk. Of course, any suitable first ingredient 190 and second ingredient 192 may be employed with the invention. For instance: (i) the first ingredient 190 may be a powder drink mix (e.g., a cocoa drink mix, a fruit drink mix, protein powder or other meal replacement type powder, et cetera) and the second ingredient 192 may be water; (ii) the first ingredient 190 may be alcohol (e.g., Tequila, Vodka, Rum, et cetera) and the second ingredient 192 may be a drink mix (e.g., margarita mix, flavored orange juice, a carbonated beverage, et cetera); (iii) the first ingredient 190 may comprise pieces of fruit and the second ingredient 192 may be a drink mix (e.g., a smoothie, Sangria, et cetera); or (iv) the first ingredient 190 may be cereal and the second ingredient 192 may be milk. As noted, however, the use of the receptacle 100 is not limited to the food and drink industry, but may also extend to products such as pharmaceutical drugs, dyes, et cetera.

In one particular embodiment, the first ingredient 190 and the second ingredient 192 may be combined to form salad dressing. In this embodiment, the first ingredient 190 may be a combination of garlic and herbs, whereas the second ingredient 192 may be, for example, olive (or another type of) oil. Garlic and herbs, when mixed with oil for long periods of time, may cause Botulism upon consumption. Botulism is a rare but serious paralytic illness that may be fatal, and cases of Botulism have caused the Food and Drug Administration to issue Emergency Permit Control Requirements for all manufacturers of salad dressing. The dual chambered receptacle 100 disclosed herein may curb cases of Botulism because the garlic and herbs of the salad dressing need not be mixed with the oil until the salad dressing is ready to be consumed.

Indeed, the receptacle 100, in addition to its convenience, may provide several other health benefits. For example, it is known that ready to drink protein drinks are generally thermally processed, which exponentially increases undesirable AGE formation therein. The present invention eliminates the need to thermally process such drinks, and provides an easy and convenient alternative for users to healthfully make their protein drinks by simply mixing the powdered protein with milk or water shortly prior to consumption.

Similarly, for example, "Thandai", one of India's more popular drinks, and which comprises flavored milk, almonds, pistachios, cashews, fennel seeds, and magaztari seeds, loses much of its nutritional value when the nuts and seeds are processed within the milk. The dual chambered receptacle 100 disclosed herein may allow the nuts and seeds to be packaged in the cup 142 as the first ingredient 190, and may enable the end user to mix them with flavored milk, the second ingredient 192, shortly before consumption. It will be understood that the various first ingredient(s) 190 and second ingredient(s) 192 specifically identified herein are merely exemplary and are not intended to be independently limiting.

In some embodiments, the first portion 110, the second portion 140, and the third portion 180 may each be manufactured using primarily the same material (e.g., plastic). In other embodiments, however, the components may be manufactured using different materials—for example, the cap 102C may comprise primarily plastic and the vessel 180 may comprise primarily glass. The seal 158 may similarly be manufactured using any suitable material (e.g., foil).

Attention is directed now to FIGS. 4A-6, which show various components of another embodiment 300 of the cap 102C. More specifically, in this embodiment 300, a first portion 310 (FIG. 6) replaces the first portion 110 of the cap 102C, a second portion 340 (FIGS. 4A-4B) replaces the second portion 140 of the cap 102C, and an end piece 370 (FIG. 5) replaces the seal 158 of the cap 102C. The vessel 180 shown in FIG. 3 and discussed above with reference to the embodiment 100 may also be utilized with the embodiment 300.

Figure 6:
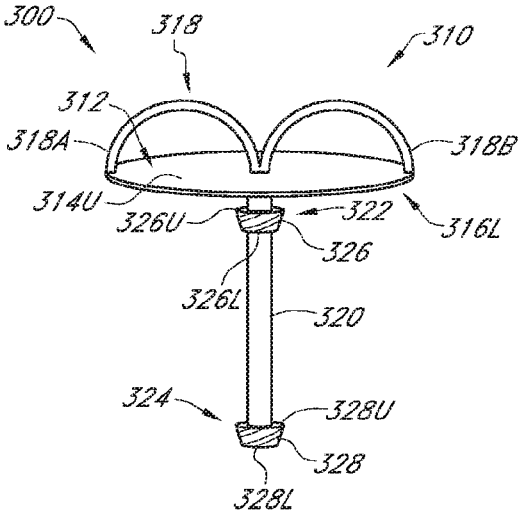
FIG. 6 is a perspective view of a first portion of the second cap.

Focus is directed now to FIG. 6, which shows the first portion 310. The first portion 310 may have a plate 312, which may be circular as shown or of other suitable shapes. The plate 312 may have an upper surface 314U and a lower surface 316L. A holding portion 318 may be secured to or formed integrally with the upper surface 314U of the plate 312. The holding portion 318, as shown in FIG. 6, may comprise ears 318A, 318B, which may allow a user to rotate the first portion 310 as discussed below. An elongated member 320, such as a cylindrical rod, may be secured to the lower surface 316L of the plate 312 and extend away from the plate 312.

The elongated member 320 may have a proximal portion 322 proximate the lower surface 316L of the plate 312, and a distal portion 324 further away from the plate 312. The elongated member 320 may comprise a first threaded member 326 at the proximal portion 322 and a second threaded member 328 at the distal portion 324. In some embodiments, the first and the second threaded members 326, 328 may be formed integrally with the elongated member 320, whereas in other embodiments, the first and second threaded members 326, 328 may be separate pieces that are respectively secured to the proximal portion 322 and the distal portion 324 of the elongated member 320. The first threaded member 326 may have upper and lower sides 326U, 326L, and the second threaded member 328 may have upper and lower sides 328U, 328L, respectively. As can be seen in FIG. 6, in some embodiments, the first threaded member 326 may be slightly wider at the upper side 326U than at the lower side 326L, and the second threaded member 328 may similarly be slightly wider at the upper side 328U than at the lower side 328L. In some embodiments, the first threaded member 326 and the second threaded member 328 may be generally identical.

Figure 4A:
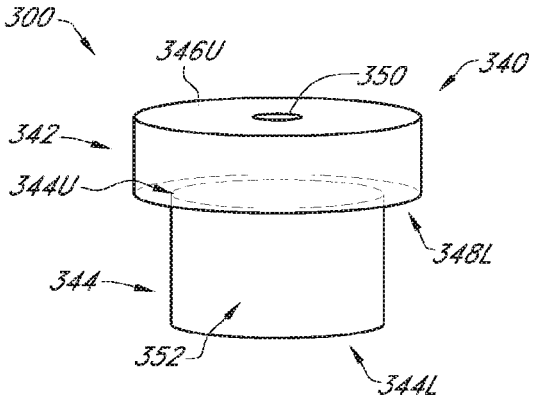
FIGS. 4A to 4B are perspective views of a second portion of a second cap, according to another embodiment.
Figure 4B:
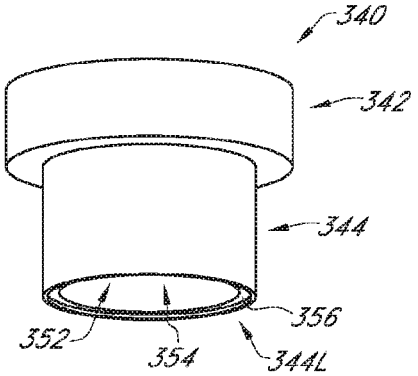
Figure 5:
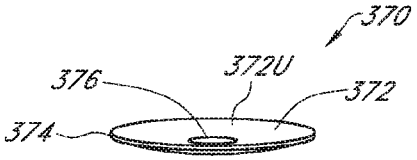
FIG. 5 is a perspective view of an end piece of the second cap.

Turning now to FIGS. 4A-4B, the second portion 340 as shown may comprise a first cylindrical portion 342 and a second cylindrical portion (or "cup") 344 adjacent thereto. The first and second cylindrical portions 342, 344 may, but need not, be of a unitary construction. A diameter of the first cylindrical portion 342 may in some embodiments be greater than a diameter of the second cylindrical portion 344. The first cylindrical portion 342 may have an upper surface 346U and a lower surface 348L. The upper surface 346U may have an opening 350 therein. While not required, in some embodiments, the opening 350 may comprise internal threading (not specifically shown).

The second cylindrical portion 344 may have an upper side 344U and a lower side 344L. The upper side 344U of the second cylindrical portion 344 may extend from the lower surface 348L of the first cylindrical portion 342. The second cylindrical portion 344 may be generally hollow and have a chamber 352 (for the retention of the first ingredient 190 as discussed above). The opening 350 in the first cylindrical portion 342 may lead to the chamber 352.

The second cylindrical portion 344, at the lower side 344L, may have an opening 354 that also leads to the chamber 352. The lower side 344L of the second cylindrical portion 344 may include a groove 356 (see FIG. 4B). The groove 356 may allow the end piece 370 (FIG. 5) to be fixedly secured to the lower side 344L of second cylindrical portion 344.

The cap 300 may be generally used as follows. The first portion 310, and more specifically, the distal portion 324 of the elongated member 320 of the first portion 310, may be passed through the opening 350 in the first cylindrical portion 342 of the second portion 340. The plate 312 or the holding portion 318 may then be used to push the elongated member 320 through the chamber 352 such that the distal portion 324 of the elongated member 320 is adjacent the groove 356 at the lower side 344L of the second cylindrical portion 340. This may cause the first threaded member 326 to mate with and seal the opening 350 in the upper surface 346U of the first cylindrical portion 342. The tapered configuration of the threaded member 326 (i.e., the fact that it may be slightly wider at the upper side 326U than at the lower side 326L) may facilitate the sealing of the opening 350 and ensure that the first threaded member 326 does not separate from the opening 350 (without user action, as discussed below). Where the opening 350 is threaded, the threaded member 326 may be secured within the opening 350 using the corresponding threading of the threaded member 326 and the opening 350 to close the opening 350.

The cap 300 (i.e., the first portion 310 as secured to the second portion 340) may now be turned upside down such that the holding portion 318 faces the ground and the lower side 344L of the second cylindrical portion 344 faces away from the ground. The chamber 352 may now be filled with the first ingredient 190 as discussed with respect to the embodiment 100.

The end piece 370 (FIG. 5) may include a body 372 having an edge 374. The body 372, at an upper side 372U, may be generally concave, and may have a hole 376 therein. The hole 376 may be configured to sealingly mate with the second threaded member 328. Specifically, once the chamber 352 is filled (or partially filled) with the first ingredient 190, and while the lower side 344L of the second cylindrical portion 344 is facing away from the ground, the end piece 370 may be used to close off the chamber 352. More specifically: (i) the edge 374 of the end piece 370 may be inserted into the groove 356 at the lower side 344L of the second cylindrical portion 344 to secure the end piece 370 to the second cylindrical portion 344; and (ii) the hole 376 of the end piece may be closed off by the passage of second threaded member 328 of the first portion 310 therethrough.

The first ingredient 190 may now be unable to escape from the chamber 354 irrespective of its orientation. Specifically, the first ingredient 190 may be unable to escape from the opening 350 in the first cylindrical portion 342 of the second portion 340 because the opening 350 is now sealed by the first threaded member 326 of the first portion 310; and further, the first ingredient 190 may be unable to escape from the opening 354 at the lower side 344L of the second cylindrical portion 344 because of the end piece 370 (and the second threaded member 328 which seals the opening 376 of the end piece 370).

The chamber 185 of the vessel 180 (see FIG. 3) may be filled with the second ingredient 192 as discussed above, and the cap 300, and more specifically the second cylindrical portion 344 of the cap 300, may now be inserted into the opening 184 of the mouth 183 of the vessel 180 to plug the vessel 180. The second ingredient 192 may thus be unable to escape from the chamber 185 of the vessel 180.

For use, a user may simply use the holding portion 318 of the first portion 310 to twist and distance the first portion 310 from the second portion 340. That is, the user may use the ears 318A, 318B to pull the plate 312 of the first portion 310 away from the first cylindrical portion 342 of the second portion 340. This may cause the second threaded member 328 to be pulled out of the hole 376 in the end piece 370. The first ingredient 190 may resultantly pass through the hole 376 in the end piece 370 into the chamber 185 of the vessel 180 and mix with the second ingredient 192. It will be appreciated that the concave surface of the body 372 of the end piece 370 may facilitate the passage of the first ingredient 190 through the hole 376 and into the chamber 185 of the vessel 180, particularly where the first ingredient 190 is a solid (e.g., a powdered substance). As before, the user may agitate the vessel 180 if desired to better mix the ingredients 190, 192.

To consume (or otherwise use) the second ingredient 192 as combined with the first ingredient 190, the user may pull out the second cylindrical portion 344 of the second portion 340 from the opening 183 in the mouth 184 of the vessel 180 to expose the opening 183. Alternatively, the user may pull out and fully separate the first portion 310 from the second portion 340 to expose the opening 350 of the second cylindrical portion 344. If desired, the user may reinsert the first portion 310 in the opening 350 to reseal the vessel 180.

Thus, as has been described, the cap 300, like the cap 102C, may allow a user to conveniently and quickly mix a first ingredient 190 with a second ingredient 192 shortly prior to use. In some embodiments, the cap 300 may be configured to be reusable; for example, the first portion 310 and the second portion 340 may be made primarily of plastic, and the end piece 370 may be made of metal (or another suitable material) to enable the cap 300 to be reused. In some embodiments, the cap 300 and the vessel 180 may be configured to be dishwasher safe to facilitate repeated use of the cap 300 with the vessel 180. It will be appreciated that the size of the various components described herein may be varied to suit a particular application.

Attention is directed now to FIGS. 7-12, which show various components of another embodiment 400 of the cap 102C. The cap 400 may include a first portion 410 (see FIG. 7), a second portion 440 (see FIG. 8), a third portion or vessel 460 (see FIG. 12), an end piece 470 (see FIG. 9), a fourth portion 480 (see FIG. 10), and a protective jacket 490 (see FIG. 11). The cap 400 may be particularly suited to retain powdered ingredients (e.g., dried powder baby food such as baby milk formula) used to prepare meals for babies.

The first portion 410 may have an inner portion 412, a perimeter portion 414, and a stopper portion 415. As can be seen, the inner portion 412 and the perimeter portion 414 may each be generally cylindrical, and a diameter of the inner portion 412 may be smaller than a diameter of the perimeter portion 414.

Figure 7:
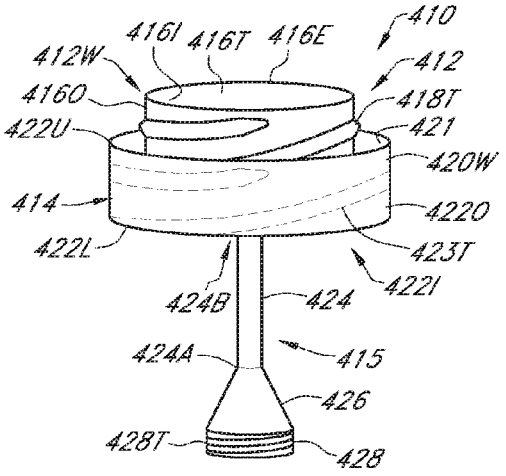
FIG. 7 is a perspective view of a first portion of a third cap, according to yet another embodiment.
Figure 10:
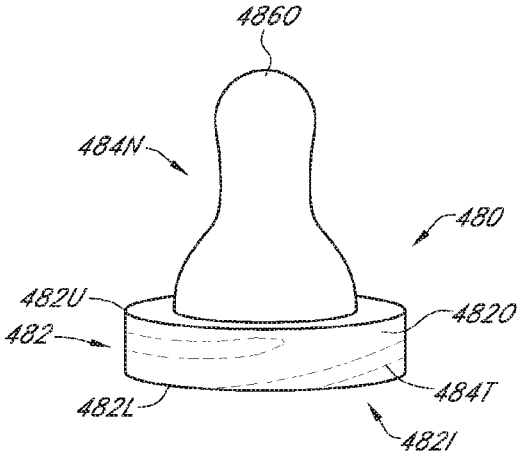
FIG. 10 is a perspective view of a fourth portion of the third cap.

The inner portion may have a generally cylindrical wall 412W having an outer surface 416O, an inner surface 416I that opposes the outer surface 416O, an upper edge 416E, and a top wall 416T. The outer surface 416O of the wall 412W may include threading 418T. The perimeter portion 414 may have a generally cylindrical sidewall 420W that surrounds part of the inner portion 412, and may have a wall 421 (not clearly shown) that extends generally horizontally. The wall 420W may have an outer surface 422O, an inner surface 422I that opposes the outer surface 422O, an upper edge 422U, and a lower edge 422L. The inner surface 422I of the wall 420W may include threading 423T, as illustrated in FIG. 7 with dotted lines.

The stopper portion 415 may include an elongated member 424 having ends 424A and 424B. The end 424B of the stopper portion 415 may be secured to the lower surface of the wall 421 of the perimeter portion 414 (e.g., via adhesive or corresponding threading, as discussed above) or to the top wall 416T. In other embodiments, the stopper portion 415 and the perimeter portion 414 may be of unitary construction.

The stopper portion 415, at the end 424A, may have a closing member 426 secured thereto. The closing member 426 may be generally conical as shown, or may take on other suitable shapes. The closing member 426 may at its lower side include a generally cylindrical wall 428, which may, at its outer surface, include threading 428T. The closing member 426, in some embodiments, may be a separate a component that is secured to the elongated member 424 (e.g., using corresponding threading, adhesive, et cetera) of the stopper portion 415. In other embodiments, the stopper portion 415 and the closing member 426 may be molded together.

Figure 8:
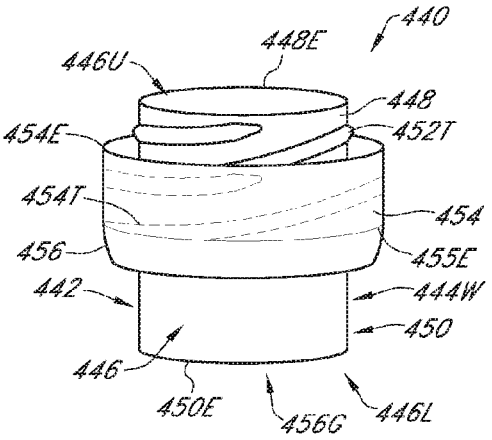
FIG. 8 is a perspective view of a second portion of the third cap.
Figure 11:
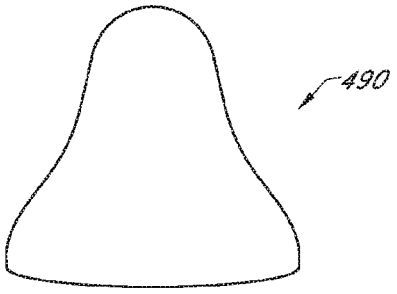
FIG. 11 is a perspective view of a protective jacket of the third cap.
Figure 9:
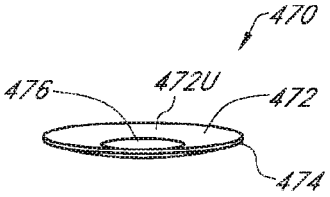
FIG. 9 is a perspective view of an end piece of the third cap.

Attention is directed now to FIG. 8, which shows the second portion 440. The second portion 440 may be generally similar to the second portion 140 (see FIG. 2) of the cap 102C. Specifically, the second portion 440 may have a cup 442 having a wall 444W. The wall 444W may be generally cylindrical as shown, and form a generally continuous hollow chamber or cavity 446 having an upper opening 446U and a lower opening 446L. The chamber 446 may be configured to retain the first ingredient 190.

The wall 444W of the cup 442 may have an upper side 448 having an edge 448E forming the upper opening 446U, and a lower side 450 having an edge 450E forming the lower opening 446L. The edges 448E, 450E, at least in some embodiments, may be generally circular. The outer surface of the lower side 450 of the wall 444W may be generally smooth, whereas the outer surface of the upper side 448 of the wall 444W may include threading 452T. The threading 452T may be configured to correspond to the threading 423T at the inner surface 422I of the wall 420W of the first portion 410. A diameter of the cup 442 at the upper side 448 may be generally equal to a diameter of the inner member 412 of the first portion 412.

The second portion 440 may further have a perimeter member 454 outwardly adjacent the cup 442. The perimeter member 454 may in some embodiments be generally cylindrical as shown, and may surround at least part of the wall 444W of the cup 442. While not clearly visible in FIG. 8, the inner surface of the perimeter member 454 may be secured to the outer surface of the wall 444W (e.g., via a generally horizontal wall that extends from the outer surface of the wall 444W to the inner surface of perimeter member 454). The perimeter member 454 may have an upper edge 454E that is downwardly adjacent the edge 448E of the cup 442, and a lower edge 455E that is upwardly adjacent the edge 450E of the cup 442. The upper edge 454E of the perimeter member 454 may generally correspond to the lower edge 422L of the first portion 410, as discussed in more detail below. While not clearly shown, the lower side 450 may include a groove 456G similar to the groove 356 of the second portion 340 (see FIG. 4B) to facilitate the securement of the end piece 470 thereto.

Much like the perimeter member 154 of the second portion 140 (see FIG. 2), the perimeter member 454 may optionally include a slanting portion 456. The slanting portion 456 may extend from the lower edge 455E of the perimeter member 454, slant towards the wall 444W of the cup 442, and terminate prior to reaching the wall 444W. The slanting portion 456 may be configured to mate with a ridge 462 (see FIG. 12) of the third portion or vessel 460.

The vessel 460 may be generally identical to the vessel 180 shown in FIG. 3. Specifically, the vessel 460 may have a mouth 463 with an opening 464, and a chamber 465 configured to receive an ingredient(s) via the opening 464 as is known in the art. The dimensions of the opening 464 may be configured such that the second portion (or plug) 440, and more specifically the lower side 450 of the cup 442, can be fitted snugly therein to plug the vessel 460. In some embodiments, a diameter of the lower side 450 of the cup 442 may be greater adjacent the perimeter member 454 than at the edge 450E, which may further facilitate the plugging of the vessel 460 by the plug 440. In some embodiments, the slanting portion 456 of the perimeter member 454 may be slid across the ridge 462 of the vessel 462 such that the slanting portion 456 grips the mouth 463 of the vessel 460, as discussed above with respect to the slanting portion 156 of the cap 102C.

The end piece 470 (FIG. 9) may include a body 472 having an edge 474. The body 472, at an upper side 472U, may be generally concave, and may have a hole 476 therein. The hole 476 may be configured to sealingly mate with the threading 428T of the closing member 426 (see FIG. 7) of the first portion 410.

Figure 12:
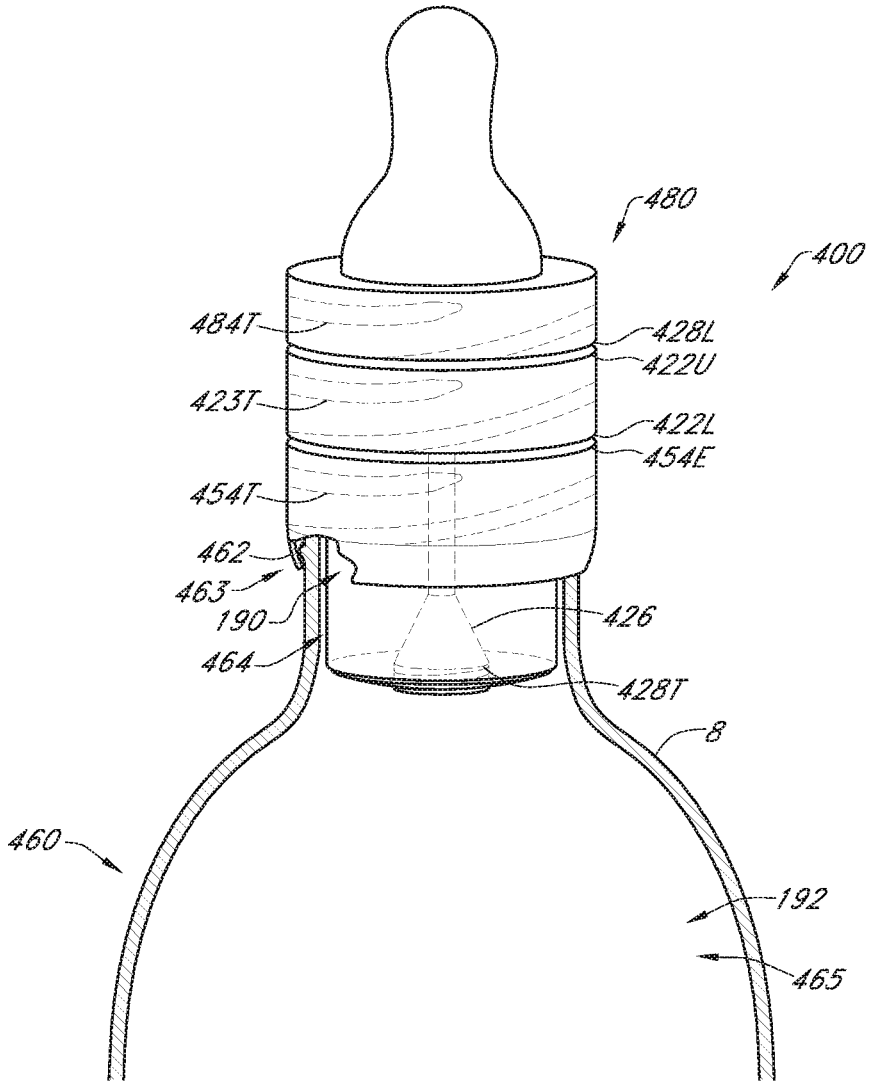
FIG. 12 is a perspective view of a receptacle with the third cap secured thereon.

The fourth portion 480 (FIG. 10) may have a cylindrical member 482 having an outer surface 482O, an inner surface 482I (not clearly visible) that opposes the outer surface 482O, an upper edge 482U, and a lower edge 482L. As best shown in FIG. 12, the inner surface 482I may comprise threading 484T which is illustrated in this figure with dotted lines. The threading 484T may be configured to mate with the threading 418T on the outer surface 416O of the wall 412 of the first portion 410, as well as the threading 452T of the second portion 440, as discussed in more detail below.

The fourth portion 480 may further have a nipple 484N upwardly adjacent the upper edge 482U. The nipple 484N may have an opening 4860 to dispense fluids at a relatively low rate, as is known in the art. The fourth portion 480, in some embodiments, may be a standard nipple attachment that can be secured to commercially available baby bottles. The protective jacket 490 (FIG. 11) may be configured to fit over the nipple 484N to protect the nipple 484N from the elements.

The cap 400 may be used as follows. The first portion 410 may first be secured to the second portion 440. More specifically, the stopper portion 415 of the first portion 410 may be passed through the upper opening 446U of the second portion 440, and the perimeter portion 414 of the first portion 410 may be secured to the upper side 448 of the wall 444W of the cup 442 of the second portion 440 using the threading 423T and the corresponding threading 452T. When so secured, the lower edge 422L of the first portion 410 may be adjacent and correspond to the upper edge 454E of the second portion 440 (see FIGS. 7, 8 and 12), and the wall 428 of the closing member 426 may slightly extend beyond the lower edge 450E of the second portion 440.

The first portion 410, as secured to the second portion 440, may now be turned upside down such that the upper edge 416E of the first portion 410 faces the ground (or another surface) and the lower edge 450E of the second portion 440 faces away from the ground. The cup 442 may then be filled with instant baby formula (or another suitable powdered substance), and the end piece 470 may be secured to the second portion 440 and the first portion 410. More specifically, the end piece 470 may be fitted within the groove 456G of the second portion 440, and secured to the closing member 426 of the first portion 410 such that at least part of the wall 428 of the closing member 426 passes through and seals the opening 476 of the end piece 470.

The first ingredient 190 may now be unable to escape from the cup 442. Specifically, the first ingredient 190 may be unable to escape from the cup 442 via the lower opening 446L because of the end piece 470 and the closing member 426, and may be unable to escape the cup 442 via the upper opening 446U because of the wall 421 of the first portion 410 or the top wall 416T. If desired, the fourth portion 480 may be secured to the wall 412W of the first portion 410 using the threading 418T (see FIG. 7) and the corresponding threading 484T of the fourth portion 480; and the protective jacket 490 may be removably secured to the fourth portion 480.

The chamber 465 of the vessel 480 may now be filled with the second ingredient 192, and the cap 400 may be used to seal off the chamber 465. Specifically, the cap 400 may be inserted into the opening 464 of the mouth 463 of the vessel 460 such that the lower side 450 of the cup 442 plugs the opening 464 of the vessel 460. The slanting portion 456 may be slid over the ridge 462 as shown in FIG. 12, and further ensure that the contents of the vessel 460 do not inadvertently escape. In some embodiments, the outer surface of the mouth 463 may include threading that correspond to threading 454T on the inner surface of the perimeter member 454; in these embodiments, the cap 400 may be threaded onto the mouth 463 of the vessel 480 to close off the chamber 465 of the vessel 460.

When it is time to feed a baby, the first portion 410 may be rotated to fully detach (i.e., unscrew) the first portion 410 (along with the fourth portion 480, which is secured to the first portion 410) from the second portion 440. This may cause the closing member 426 to come out of the opening 476 in the end piece 470. The first ingredient 190 may resultantly fall from the cup 442 into the chamber 465 of the vessel 460 via the opening 476 and mix with the second ingredient 192. The fourth portion 480 may now be unscrewed from the first portion 410 and screwed onto the second portion 440 using the threading 484T of the fourth portion 480 and the corresponding threading 452T of the second portion 440. The vessel 460 may hence be used as a conventional baby bottle. The cap 400 may be reused as desired along with the vessel 460 to house the first ingredient 190 and the second ingredient 192, respectively.

Thus as has been described, because each of the first portion 410, the second portion 440, the end piece 470, the fourth portion 480, the jacket 490, and the vessel 460 may be carried and transported together as one unit, the cap 400 may allow a parent (or other guardian) to conveniently form milk from baby formula on the go, without the need to carry a separate bottle with a nipple and an additional container to carry the baby formula.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described. Directional labels such as up, down, left, right, upwardly adjacent, downwardly adjacent, et cetera, are meant to describe the invention in a typical configuration or orientation, but are not intended to be independently limiting.

The invention claimed is:

1. A dual chambered receptacle configured to retain a first ingredient and a second ingredient, comprising:

a first portion having a cover and a rupturing member; the cover including a top portion and a side portion having threading; the rupturing member extending from the top portion and having an elongated member and a rupturing portion;

a second portion having a cup and a perimeter portion; the cup being configured to retain the first ingredient, and comprising an upper side having an upper edge and a lower side having a lower edge; the upper side comprising threading; the perimeter portion being spaced apart from and surrounding the cup, and having a top edge and a bottom edge; in a use configuration, the top edge being below the upper edge and the bottom edge being above the lower edge;

a seal coupled to the rupturing portion and the lower edge when the cover is threadingly secured to the upper side; and a vessel having a mouth; the vessel being configured to retain the second ingredient; the mouth being configured to be plugged by the lower side;

wherein, the seal is configured to detach from the lower edge to allow the first ingredient to fall into the vessel to mix with the second ingredient when the first portion is moved relative to the second portion.

2. The dual chambered receptacle of claim 1 wherein the perimeter portion further comprises a slanting portion configured to slide over a ridge on the mouth.

3. The dual chambered receptacle of claim 1 wherein the rupturing portion is frusto-conical.

4. The dual chambered receptacle of claim 3 wherein a diameter of the lower side adjacent the perimeter portion is greater than a diameter of the lower side at the lower edge.

5. A dual chambered receptacle configured to retain a first ingredient and a second ingredient, comprising:

a first portion having a cover and a rupturing member;

a second portion having a cup and a perimeter portion spaced apart from the cup; the cup comprising an upper side having an upper edge and a lower side having a lower edge; the upper side comprising threading; the perimeter portion having a top edge and a bottom edge; in a use configuration, the top edge being below the upper edge and the bottom edge being above the lower edge; the second portion being configured to be removably secured to the first portion; the cup being configured to retain the first ingredient;

a seal coupled to the rupturing member and the lower edge when the first portion is removably secured to the second portion; and a vessel having a mouth; the vessel being configured to retain the second ingredient;

wherein, the seal is configured to detach from the lower edge to allow the first ingredient to fall into the vessel to mix with the second ingredient when the first portion is moved relative to the second portion.

6. The dual chambered receptacle of claim 5 wherein the rupturing member includes a cylindrical elongated member coupled to a frusto-conical rupturing portion.

7. The dual chambered receptacle of claim 6 wherein the cover comprises threading configured to mate with the threading on the cup.

8. The dual chambered receptacle of claim 7 wherein the perimeter portion surrounds the cup.

9. The dual chambered receptacle of claim 5 wherein the perimeter portion further comprises a slanting portion configured to slide over a ridge on the mouth.

10. The dual chambered receptacle of claim 5 wherein an end of the rupturing member and an end of the cup are coplanar when the first portion is removably secured to the second portion.

11. A cap for a vessel being configured to retain a first ingredient, the cap comprising:

a first portion having a cover and a rupturing member extending therefrom;

a second portion having a cup and a perimeter portion spaced apart from the cup; the cup comprising an upper side having an upper edge and a lower side having a lower edge; the upper side comprising threading; the perimeter portion having a top edge and a bottom edge; in a use configuration, the top edge being below the upper edge and the bottom edge being above the lower edge; the second portion being configured to be removably secured to the first portion; the cup being configured to retain a second ingredient; and a seal coupled to the rupturing member and the lower edge when the first portion is removably secured to the second portion;

wherein the seal is configured to rupture upon movement of the first portion relative to the second portion.

12. A cap for a vessel being configured to retain a first ingredient, the cap comprising:

a first portion having a cover and a rupturing member extending therefrom;

a second portion having a cup and a perimeter portion spaced apart from the cup; the cup comprising an upper side having an upper edge and a lower side having a lower edge; the upper side comprising threading; the perimeter portion having a top edge and a bottom edge; in a use configuration, the top edge being below the upper edge; the second portion being configured to be removably secured to the first portion; the cup being configured to retain a second ingredient; and a seal coupled to the rupturing member and the lower edge when the first portion is removably secured to the second portion;

wherein the seal is configured to rupture upon movement of the first portion relative to the second portion.

13. A method of mixing a first ingredient with a second ingredient, comprising:

providing a dual chambered receptacle, comprising:

(1) a first portion having a cover and a rupturing member extending therefrom;

(2) a second portion having a cup and a perimeter member spaced apart from and at least partially surrounding the cup; the cup comprising an upper side having an upper edge and a lower side having a lower edge; the upper side comprising threading; the perimeter member having a top edge and a bottom edge; in a use configuration, the top edge being below the upper edge and the bottom edge being above the lower edge; and (3) a vessel having a mouth;

removably securing the first portion to the second portion;

situating the first ingredient in the cup and the second ingredient in the vessel;

coupling a seal to the rupturing member and the lower edge to temporarily seal the cup;

plugging the mouth with the cup; and moving the first portion relative to the second portion to rupture the seal, thereby causing the first ingredient to fall into the vessel.

14. The method of claim 13 wherein the step of moving the first portion relative to the second portion includes distancing the first portion from the second portion.

15. The method of claim 13 wherein the rupturing member has an elongated portion and a rupturing portion.

16. The method of claim 15 wherein the rupturing portion is frusto-conical.

17. The method of claim 13 wherein the perimeter member includes a slanting portion configured to slide over a ridge on the mouth.

18. The method of claim 13 wherein the step of moving the first portion relative to the second portion includes unthreading the first portion from the second portion.

* * * * *